US011357090B2

(12) United States Patent
Aliakseyeu

(10) Patent No.: US 11,357,090 B2
(45) Date of Patent: Jun. 7, 2022

(54) STORING A PREFERENCE FOR A LIGHT STATE OF A LIGHT SOURCE IN DEPENDENCE ON AN ATTENTION SHIFT

(71) Applicant: SIGNIFY HOLDING B.V., Eindhoven (NL)

(72) Inventor: Dzmitry Viktorovich Aliakseyeu, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 47 days.

(21) Appl. No.: 16/639,658

(22) PCT Filed: Jul. 31, 2018

(86) PCT No.: PCT/EP2018/070679
§ 371 (c)(1),
(2) Date: Feb. 17, 2020

(87) PCT Pub. No.: WO2019/034407
PCT Pub. Date: Feb. 21, 2019

(65) Prior Publication Data

US 2020/0253021 A1 Aug. 6, 2020

(30) Foreign Application Priority Data

Aug. 17, 2017 (EP) ..... 17186539

(51) Int. Cl.
*H05B 47/125* (2020.01)
*H05B 47/175* (2020.01)

(52) U.S. Cl.
CPC ..... *H05B 47/125* (2020.01); *H05B 47/175* (2020.01)

(58) Field of Classification Search
None
See application file for complete search history.

(56) References Cited

U.S. PATENT DOCUMENTS 1,001,305 A * 8/1911 Rix ..... F04B 39/1033 417/567
5,982,555 A * 11/1999 Melville ..... G06V 40/19 351/209
8,687,840 B2 * 4/2014 Samanta Singhar . G06F 1/3231 382/117
9,137,878 B2 * 9/2015 Thompson ..... H05B 47/115
(Continued)

FOREIGN PATENT DOCUMENTS

CA 2748984 A1 7/2010
DE 102014013165 A1 3/2016
(Continued)

*Primary Examiner* — Srinivas Sathiraju

(57) ABSTRACT

An electronic device is configured to change a light state, e.g. the brightness, of at least one light source (11) while a user is watching content being displayed on a display (19) and detect the user's attention shifting away from the display (19). The electronic device is further configured to determine whether the attention shift coincides with the change of the light state and store a preference for the light state in dependence on the attention shift coinciding with the change of the light state. The preference is preferably a preference for a light state with a less pronounced light effect than the changed light state.

20 Claims, 4 Drawing Sheets

(56) References Cited

U.S. PATENT DOCUMENTS 9,374,872 B2 * 6/2016 Krall ..... H05B 47/11
9,727,136 B2 * 8/2017 Wilairat ..... G02B 27/0093
9,746,686 B2 * 8/2017 Haddick ..... G06T 19/006
9,766,701 B2 * 9/2017 Plowman ..... G09G 3/20
9,805,508 B1 * 10/2017 Jagmag ..... G06T 11/60
9,870,752 B2 * 1/2018 Plowman ..... G09G 5/00
10,013,055 B2 * 7/2018 Perek ..... G02B 27/0172
10,178,738 B2 * 1/2019 Krall ..... H05B 47/11
10,285,245 B2 * 5/2019 Meerbeek ..... H05B 47/19
10,345,600 B1 * 7/2019 Chi ..... G02B 27/0093
10,477,646 B2 * 11/2019 Krall ..... H05B 45/20
10,553,146 B2 * 2/2020 Pyo ..... G09G 3/3233
10,755,632 B2 * 8/2020 Tseng ..... G06F 3/013
10,884,492 B2 * 1/2021 Eash ..... G06F 3/013
2003/0146901 A1 * 8/2003 Ryan ..... G06V 10/25
345/158
2006/0227125 A1 * 10/2006 Wong ..... G09G 5/14
345/211
2012/0288139 A1 * 11/2012 Singhar ..... G06F 1/3231
382/103
2013/0278150 A1 * 10/2013 Lou ..... H05B 47/115
315/155
2014/0139542 A1 * 5/2014 Plowman ..... G06F 3/0304
345/589
2014/0145940 A1 * 5/2014 Plowman ..... G09G 5/10
345/156
2014/0320021 A1 * 10/2014 Conwell ..... G06F 3/0485
315/152
2015/0061504 A1 * 3/2015 Krall ..... H05B 31/50
315/297
2015/0331485 A1 * 11/2015 Wilairat ..... G06F 1/163
345/156
2016/0026253 A1 * 1/2016 Bradski ..... H04N 13/344
345/8
2016/0152178 A1 * 6/2016 Peterson ..... B60Q 3/80
315/77
2016/0295666 A1 * 10/2016 Krall ..... H05B 31/50
2016/0338166 A1 * 11/2016 Knaapen ..... H05B 47/115
2016/0345407 A1 * 11/2016 Nolan ..... H05B 47/19
2017/0208292 A1 * 7/2017 Smits ..... H04N 13/324
2017/0294156 A1 * 10/2017 Pyo ..... G09G 3/3233
2017/0320946 A1 * 11/2017 Colonna ..... C07K 14/70503
2018/0133900 A1 * 5/2018 Breazeal ..... B25J 19/026
2019/0094981 A1 * 3/2019 Bradski ..... G06F 3/017
2019/0116644 A1 * 4/2019 Krall ..... H05B 47/105
2022/0015212 A1 * 1/2022 Aliakseyeu ..... H05B 47/19

FOREIGN PATENT DOCUMENTS

EP 3136826 B1 5/2019
WO 2014006525 A2 1/2014
WO 2016156462 A1 10/2016

* cited by examiner

STORING A PREFERENCE FOR A LIGHT STATE OF A LIGHT SOURCE IN DEPENDENCE ON AN ATTENTION SHIFT

Cross-Reference to Prior Applications

This application is the U.S. National Phase application under 35 U.S.C. §371 of International Application No. PCT/EP2018/070679, filed on Jul. 31, 2018, which claims the benefit of European Patent Application No. 17186539.7, filed on Aug. 17, 2017. These applications are hereby incorporated by reference herein.

FIELD OF THE INVENTION

The invention relates to an electronic device for changing a light state of at least one light source.

The invention further relates to a method of changing a light state of at least one light source.

The invention also relates to a computer program product enabling a computer system to perform such a method.

BACKGROUND OF THE INVENTION

Light can be used to enhance entertainment experiences. With the rise of smart home technologies, specifically smart lighting, e.g. Philips Hue, colored and dynamic lighting can be used to enhance home entertainment experiences, immersing people into their entertainment experiences. A well-known add-on of light to video content is Philips' Ambilight™ technology. Lights embedded in a Philips Ambilight TV and Philips Hue connected lights can be used as entertainment lights to enhance content displayed on the TV screen. One key observation during the evaluation of Philips' Hue was the existence of differences in peoples' preferences for the maximum brightness or intensity of light effects and the dependence of someone's preference on the type of content, the location of the lights and the brightness of the TV screen. However, users would likely consider manual configuration of a maximum brightness or intensity of light effects to be too cumbersome and would instead prefer to switch off the entertainment lights, especially as the maximum brightness or intensity would likely need to be adjusted regularly.

SUMMARY OF THE INVENTION

It is a first object of the invention to provide an electronic device, which can automatically determine and store a user preference for a light state of a light source.

It is a second object of the invention to provide a method, which can automatically determine and store a user preference for a light state of a light source.

In a first aspect of the invention, the electronic device comprises at least one processor configured to change a light state of at least one light source while a user is watching content being displayed on a display, detect said user's attention shifting away from said display, determine whether said attention shift coincides with said change of said light state, and store a preference for said light state in dependence on said attention shift coinciding with said change of said light state.

The inventor has recognized that people have a certain preference for the maximum brightness or intensity of light effects, because they are distracted by a light effect that is too bright or too intense. There seems to be a threshold brightness where instead of being of immersive, light becomes distracting. Furthermore, the brightness threshold seems to change regularly, e.g. when the location of a lamp, the type of displayed content or the brightness of the TV screen changes. By detecting whether a user's attention shifts away from the display and determining whether this coincides with a change of a light state, it is possible to automatically determine and store a preference for said light state, preferably a preference with a less pronounced light effect than said changed light state.

Said preference may comprise a preference for a maximum intensity and/or a maximum brightness of said light state, for example. Preferably, the light state change (i.e. the light effect) has a relationship to the displayed content. This relationship may be determined by a first function (e.g. if the displayed content has a dominant color X and/or an average intensity X, then a light effect with color X and/or intensity X may be created), and this function may change to a second function based on the preference (e.g. the preference may be to avoid color X or to keep the intensity below Y).

Said at least one processor may be configured to start controlling said at least one light source based on said preference upon determining that said attention shift coincides with said change of said light state. Alternatively, said at least one processor may be configured to represent said preference on a display, allow said user to accept said preference and start controlling said at least one light source based on said preference upon said user accepting said preference. Controlling said light source may comprise making sure that a certain maximum intensity and/or a maximum brightness of said light state is not exceeded. Taking into account the preference upon determining that the attention shift coincides with the change of the light state allows the user to benefit from the new preference while still watching the current content. However, some users may dislike automatic preference adjustments and may prefer more control.

Said at least one processor may be configured to store said preference and/or start controlling said at least one light source based on said preference upon determining that said attention shift has occurred a predetermined number of times coincident with a change of said light state. To make sure that the changed light state (i.e. the light effect) is indeed distracting, an attention shift may need to occur multiple times coincident with the attention shift before the preference is stored (e.g. before a maximum brightness is set or changed). This is especially beneficial if it is not possible to establish with sufficient certainty that the user's attention shifts towards a light source whose light state is being changed. The predetermined number of times may depend on one or more factors, e.g. which light state is changed. Since almost every light effect typically has a different brightness/intensity level, it may be possible to more precisely determine the preference after the attention shift has occurred multiple times, even if the user's behavior is only observed for a short time.

Said at least one processor may be configured to store in history data whether said attention shift coincides with said change of said light state, said history data further indicating how many previous attention shifts have coincided with previous changes of a light state of at least one light source, and store said preference and/or start controlling said at least one light source based on said preference in dependence on said history data. To make sure that the changed light state (i.e. the light effect) is indeed distracting, it may be beneficial to take into account how many previous attention shifts have coincided with previous changes of a light state of at least one light source (not necessarily the same at least one light source whose light state is currently being changed). This is especially beneficial if it is not possible to establish with sufficient certainty that the user's attention shifts towards a light source whose light state is being changed. For example, a user that looks away often for other reasons might need to look away during a number of changes before the preferred value is established, whereas a user that generally does not look away may trigger the establishment of the preferred value the very first time he looks away during a change.

Said at least one processor may be configured to store said preference for said light state in dependence on said attention shift coinciding with said change only during a predetermined period. In case users dislike automatic preference adjustments, they can be reduced in number by only storing (e.g. setting or changing) the preference during a predetermined period, for example during the first minutes of watching the content.

Said at least one processor may be configured to detect said user's attention shifting away from said display based on information representing changes in an orientation of said user's head and/or in said user's gaze. Techniques for detecting changes in an orientation of the user's head and/or in the user's gaze are well known and can be conveniently used to detect the user's attention shifting away.

Said at least one processor may be configured detect said orientation of said user's head or said user's gaze moving in the direction of one or more of said at least one light source. If the orientation of the user's head or user's gaze moves away from the display, the user is most likely distracted, but it may not be possible to determine what has distracted the user. By detecting that the orientation is moving in the direction one or more of the at least one light source, it is more likely that it was this light source that distracted the user.

Said information may be received from augmented reality glasses. Augmented reality glasses are typically able to detect changes in an orientation of the user's head and/or in the user's gaze more accurately than a camera close to the display, because they are positioned closer the user's head.

Said at least one processor may be configured to detect said user's attention shifting towards one or more of said at least one light source. By detecting that the user's attention is shifting towards one or more of the at least one light source, it can be determined with an even higher accuracy/reliability that it was this light source (i.e. the light effect created by the light source) that distracted the user.

Said at least one processor may be configured to determine a new preference value for said preference by reducing or increasing a current preference value of said preference by a certain amount, said certain amount being predefined in said electronic device or being specified in a light script. Although it is normally easy to determine that a changed light state, i.e. a light effect, may be distracting, it is often not possible to determine immediately which light effect would not be distracting. The amount by which the current preference value is reduced (e.g. when the current preference level specifies a value not to be exceeded) or increased (e.g. when the current preference level specifies a percentage by which a parameter in a light command should be reduced) may be small, which increases the chance that the preference will converge to the maximum value that does not create a distracting light effect, or may be large, which decreases the chance that the next light effect will be distracting. The choice for the amount by which the current preference value is reduced or increased may be made by a user or manufacturer of the electronic device or by the author of a light script.

In a second aspect of the invention, the method comprises changing a light state of at least one light source while a user is watching content being displayed on a display, detecting said user's attention shifting away from said display, determining whether said attention shift coincides with said change of said light state, and storing a preference for said light state in dependence on said attention shift coinciding with said change of said light state. The method may be implemented in hardware and/or software.

Moreover, a computer program for carrying out the methods described herein, as well as a non-transitory computer readable storage-medium storing the computer program are provided. A computer program may, for example, be downloaded by or uploaded to an existing device or be stored upon manufacturing of these systems.

A non-transitory computer-readable storage medium stores at least one software code portion, the software code portion, when executed or processed by a computer, being configured to perform executable operations comprising: changing a light state of at least one light source while a user is watching content being displayed on a display, detecting said user's attention shifting away from said display, determining whether said attention shift coincides with said change of said light state, and storing a preference for said light state in dependence on said attention shift coinciding with said change of said light state.

As will be appreciated by one skilled in the art, aspects of the present invention may be embodied as a device, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit", "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of devices, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

BRIEF DESCRIPTION OF THE DRAWINGS

These and other aspects of the invention are apparent from and will be further elucidated, by way of example, with reference to the drawings, in which.

Corresponding elements in the drawings are denoted by the same reference numeral.

DETAILED DESCRIPTION OF THE EMBODIMENTS

Figure 1:
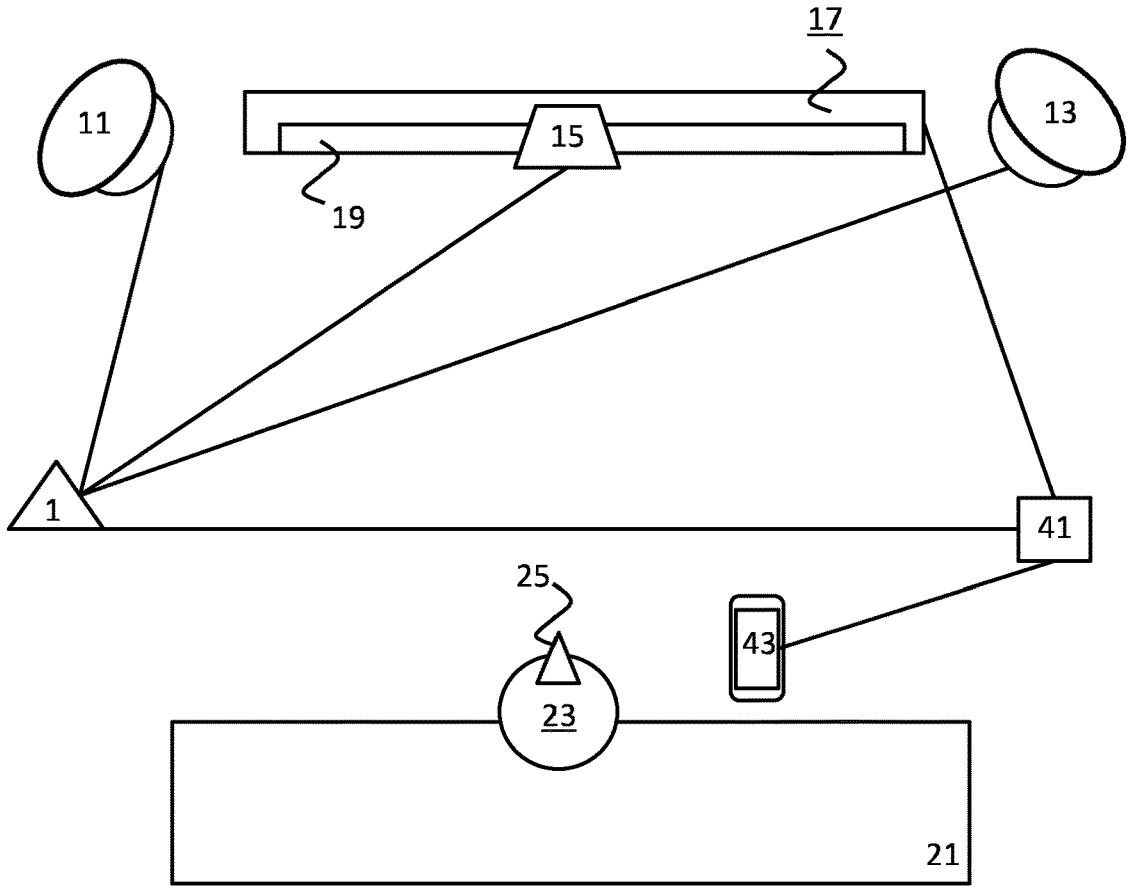
FIG. 1 is a block diagram of a system comprising a first embodiment of the electronic device of the invention.

FIG. 1 shows a first embodiment of an electronic device of the invention, a bridge 1. The bridge 1 controls lamps 11 and 13, e.g. via ZigBee or a protocol based on ZigBee. The bridge 1 is connected to a wireless LAN (e.g. Wi-Fi/IEEE 802.11) access point 41, via a wire or wirelessly. Mobile device 43, e.g. a mobile phone or a tablet, is also connected to the Internet via wireless LAN access point 41. A user of the mobile device 43 is able to associate the lamps 11 and 13 with names, create named rooms, assign the lamps 11 and 13 to the named rooms, and control the lamps 11 and 13 via a touchscreen of the mobile device 43. The light and room names and the light to room associations are stored on the mobile device 43.

A Television 17 comprises a display 19 on which it displays content. On top of the television is a camera 15. The camera 15 transmits data to the bridge 1. In the embodiment of FIG. 1, this data is transmitted via ZigBee or a protocol based on ZigBee. In an alternative embodiment, this data is transmitted via Bluetooth or via the wireless LAN access point 41, for example. The Television 17 analyzes the content displayed on the display 19 and transmits the results of the analysis to the mobile device 43 as a continuous stream. In this embodiment, these results comprise color and intensity values per edge region of the display 19 for several edge regions. The mobile device 43 maps the results to the lamps 11 and 13 based on the locations of the lamps 11 and 13, e.g. a left edge region of the display is mapped to lamp 11 and a right edge region is mapped to lamp 13. The mobile device 43 then controls lamps 11 and 13 based on this mapping. In an alternative embodiment, the above-described functions of the mobile device 43 are performed by the device displaying the content, e.g. by Television 17 or by a game console. For example, the app running on the mobile device 43 would instead be running on the device displaying the content. A person 23 is sitting on a couch 21 looking at the display 19. This is depicted in FIG. 2 by the nose 25 of the person 23 pointing in the direction of the display 19.

Figure 2:
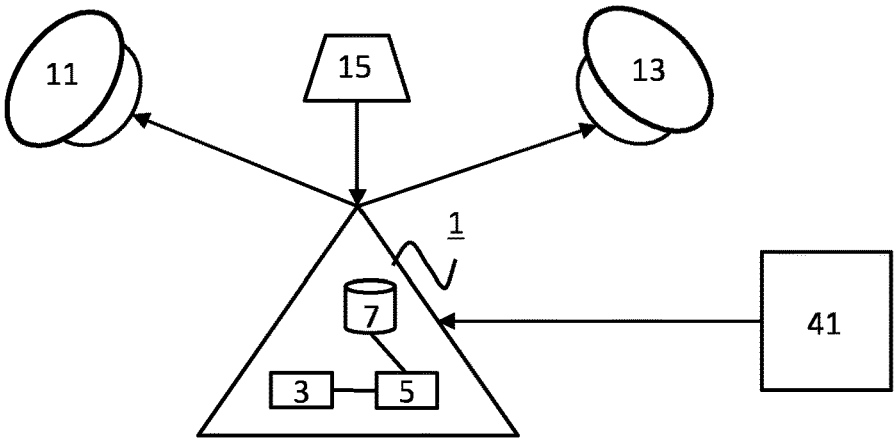
FIG. 2 is a block diagram of the first embodiment of the electronic device of FIG. 1.

The bridge 1 comprises a processor 5, a transceiver 3 and storage means 7, see FIG. 2. The processor 5 is configured to change a light state, e.g. the brightness, of lamp 11 and/or 13 while a user is watching content being displayed on a display 19 of a Television 17, detect the user's attention shifting away from the display 19 based on data received from camera 15, determine whether the attention shift coincides with the change, and store a preference for the light state in dependence on the attention shift coinciding with the change. The preference comprises a preference for a light state with a less pronounced light effect than the changed light state (i.e. than the light state which is believed to have caused the attention shift). The arrows indicated in FIG. 2 are for illustrative purposes only, i.e. they illustrate the previously described communications, and do not exclude that communication takes places in a direction not indicated in FIG. 2.

Figure 3:
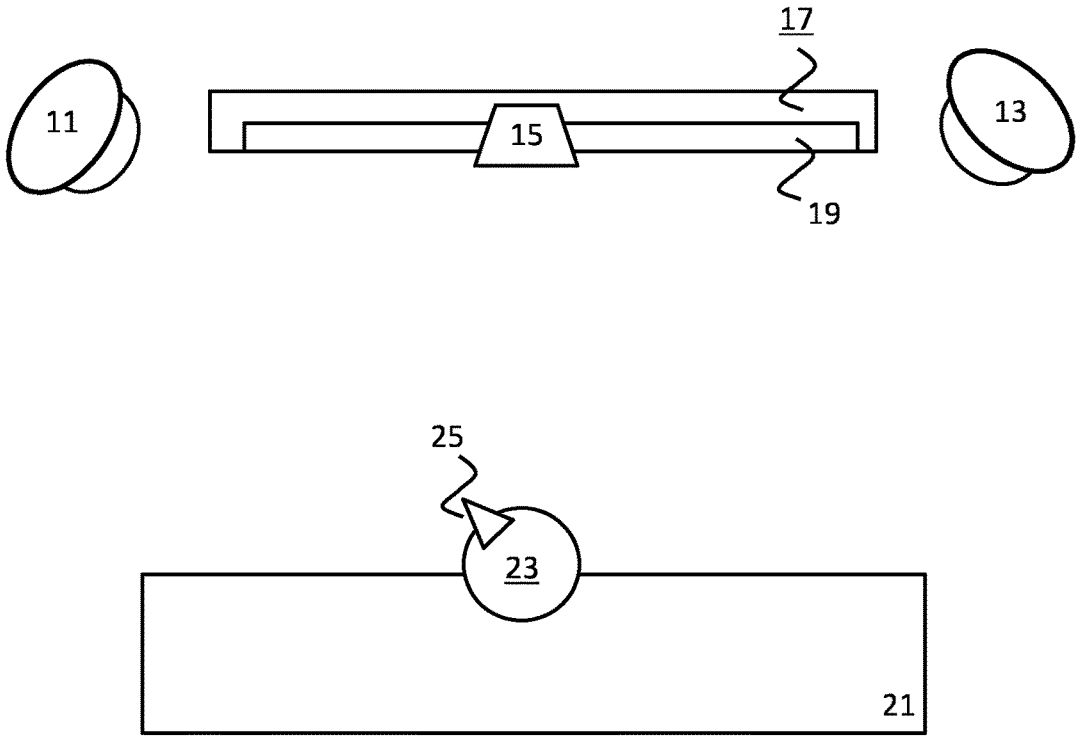
FIG. 3 depicts a shift in attention away from a display that cannot be attributed to a light effect.
Figure 4:
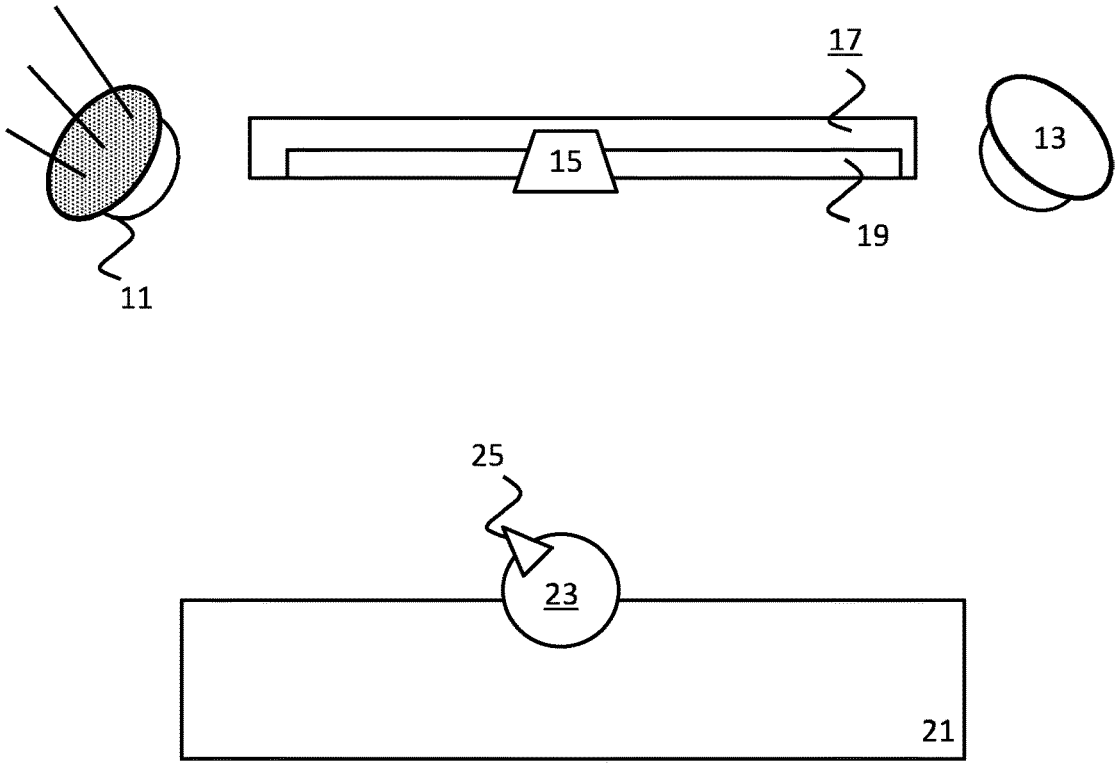
FIG. 4 depicts a shift in attention away from a display that can be attributed to a light effect.

FIG. 3 depicts the attention of the person 23 shifting away from the display 19 towards the lamp 11 on which no light effect is being rendered (nose 25 is now pointing in the direction of lamp 11). Since no light effect is being rendered, this attention shift does not coincide with a change of a light state and cannot be attributed to a light effect. FIG. 4 depicts the attention of the person 23 shifting away from the display 19 towards the lamp 11 of which the light state has just been changed. For example, a light effect with maximum brightness may be rendered on the lamp 11. Since this attention shift coincides with the change of the light state, it can be attributed to this change.

In the embodiment of FIG. 2, the bridge 1 continuously adapts the preference while the person 23 is using the Television 17. This adaptation is continuous in this embodiment, because the level of distraction can change due to changes of the overall light level in the room and changes in how engaging the current moment in the game or a movie is, amongst others. In an alternative embodiment, the processor 5 is configured to store the preference for the light state in dependence on the attention shift coinciding with the change only during a predetermined period. For example, the adaptation may only be active the first several minutes to identify the desired level of intensity that can be then fixed for the rest of the gaming session or movie watching activity. In another embodiment, the adaptation could be a part of the startup procedure of the display device, e.g. the brightness of a lamp could be increased while content is being displayed to see at what level the lamp becomes distracting and once the optimal brightness is defined, no further changes are made.

Most modern game consoles and certain TV models have some form of user tracking (e.g. Microsoft Kinect, PlayStation camera) using a camera. These devices could be used for estimating the focus of a user's attention. In the embodiment of FIG. 2, a stand-alone camera 15 that is located on top of the Television 17 is used for this purpose. In this embodiment, the processor 5 is configured to detect the user's attention shifting away from the display 19 based on information representing changes in an orientation of the user's head. In an alternative embodiment, the processor 5 is additionally or alternatively configured to detect the user's attention shifting away from the display 19 based on information representing changes in the user's gaze. Techniques for detecting changes in an orientation of a user's head and for detecting changes in a user's gaze are well known. In another embodiment, the information representing changes in an orientation of the user's head and/or changes in the user's gaze may be received from augmented reality glasses, e.g. Google Glass, instead of from a camera embedded in or connected to a game console or TV.

The camera 15 provides captured images to the bridge 1 when motion is detected. The bridge 1 then analyzes these images. In an alternative embodiment, the camera 15 provides the bridge 1 with high level data on the head or gaze direction. In the embodiment of FIG. 2, the processor 5 is configured to detect the user's attention shifting towards the lamp 11 or the lamp 13. The bridge 1 uses its knowledge about the locations of the lamps 11 and 13 to identify the specific lamp to which the user is looking. In an alternative embodiment, the processor 5 only determines whether the orientation of the user's head and/or the user's gaze has changed or not, and optionally detects that the orientation has moved in the direction of lamp 11 or lamp 13, but does not detect whether the user is actually looking at the lamp 11 or the lamp 13.

In the embodiment of FIG. 2, the processor 5 is configured to start controlling the lamp 11 and/or the lamp 13 based on the preference upon determining that the attention shift coincides with the change of light state. For example, the adapted preference may be used the next time a light state of the lamp 11 and/or the lamp 13 needs to be changed, i.e. the next time a light effect needs to be rendered. Lamps 11 and 13 may have the same preference or different preferences, e.g. the same or a different maximum brightness. The latter may be beneficial if one of the lamps 11 and 13 is located much farther away from the person 23 or from a reference position of the person 23, e.g. the couch 21, than the other lamp. If the processor 5 records preferences for lamps 11 and 13 individually e.g. if the user is more distracted by lamp 11 than by lamp 13, then the maximum brightness for lamp 11 is set lower than for lamp 13 and an effect that is played simultaneously on both lamps might be rendered in one of the following ways:

(1) the processor 5 can change the intensity of the lamps separately so that the lamp 11 will shine less bright than lamp 13 during the effect; or (2) the processor 5 can also limit the intensity of lamp 13 based on the preference associated with lamp 11 to ensure an even looking effect, but only for the duration of the simultaneous effect.

In an alternative embodiment, the processor 5 is configured to represent the preference, e.g. as one or more values, on a display, e.g. a display of the mobile device 43, and allow the user to accept the preference and start controlling the lamp 11 and/or the lamp 13 based on the preference upon the user accepting the preference. In other words, instead of immediately adapting the brightness, the bridge 1 might record this information first and then present it to the user (e.g. in a app running on the mobile device 43) and offer to change the brightness in the future accordingly.

In the embodiment of FIG. 2, the processor 5 is configured to store the preference and/or start controlling the lamp 11 and/or the lamp 13 based on the preference upon determining that the attention shift has occurred a predetermined number of times coincident with a change of the light state. In the embodiment of FIG. 2, whether the adaptation of the preference happens immediately or only after the processor 5 has detected the shift several times depends on a system setting.

The speed and level of adaptation may be varied between different effects. For example, the preference may be adapted more frequently for very frequent effects, but with smaller steps (e.g. every time the attention shift is detected the brightness is only reduced slightly). The preference might not need to be adapted for very rare and very intense effects at all, as these effects might naturally be designed to be "distracting". In some cases, where for example intensity of the effect is defined by the brightness, the adaptation could have global impact and be applied to all effects by for example introducing a brightness maximum.

In the embodiment of FIG. 2, the processor 5 is only configured to store in history data on storage means 7 the number of times an attention shift coincides with a change of a light state. In an alternative embodiment, the processor 5 is configured to store in history data on storage means 7 whether or not the attention shift coincides with the (present) change of light state, the history data further indicating how many previous attention shifts have coincided with previous changes of a light state of the lamp 11 and/or the lamp 13, and store the preference and/or start controlling the lamp 11 and/or the lamp 13 based on the preference in dependence on the history data. The processor 5 may be configured store the preference and/or start controlling the lamp 11 and/or the lamp 13 a higher number of times if the user looks away often for other reasons than if the user generally does not look away. In the latter case, the processor 5 may be configured store the preference and/or start controlling the lamp 11 and/or the lamp 13 the first time an attention shift coincides with a change of the light state. Instead of on the storage means 7, history data may be stored on a server in a local area network or on the Internet, for example.

In the embodiment of FIG. 2, the adaption of the preference comprises reducing the brightness of future effects of the same type. In an alternative embodiment, brightness and color saturation are considered to both contribute to the intensity of an effect and both brightness and saturation of future effects of the same type are reduced (adapted). The adaptation may additionally or alternatively involve replacing a color that is distracting with another color. In the embodiment of FIG. 2, the processor 5 is configured to determine a new preference value of the preference by reducing or increasing a current preference value of the preference by a certain amount predefined in the bridge 1 (e.g. 5%) or specified in a light script, e.g. a light script that is played together with a movie.

In the embodiment of FIG. 2, the bridge 1 controls the light states of lamps 11 and 13 based on the stored preference(s), but it is the mobile device 43 which renders light scripts and generates commands and not the bridge 1, so the bridge 1 is not able to adapt light effects as smartly as the mobile device 43 would be able to. For example, the bridge 1 does not know the range of brightness values that the mobile device 43 will use, so converting an input brightness value to an output brightness value might lead to poor results. However, the bridge 1 is able to ensure a maximum brightness value, i.e. if it receives a light command with a brightness higher than the maximum it will change the output brightness to be below the maximum.

In the embodiment of the bridge 1 shown in FIG. 2, the bridge 1 comprises one processor 5. In an alternative embodiment, the bridge 1 comprises multiple processors. The processor 5 of the bridge 1 may be a general-purpose processor, e.g. from ARM or Intel, or an application-specific processor. The processor 5 of the bridge 1 may run a Linux operating system for example. In the embodiment shown in FIG. 2, a receiver and a transmitter have been combined into a transceiver 3. In an alternative embodiment, one or more separate receiver components and one or more separate transmitter components are used. In an alternative embodiment, multiple transceivers are used instead of a single transceiver. The transceiver 3 may use one or more wireless communication technologies to transmit and receive data, e.g. Wi-Fi, ZigBee and/or Bluetooth. The storage means 7 may store the preference(s) and information identifying the available light sources, e.g. lamps 11 and 13, for example. The storage means 7 may comprise one or more memory units. The storage means 7 may comprise solid state memory, for example. The invention may be implemented using a computer program running on one or more processors.

Figure 5:
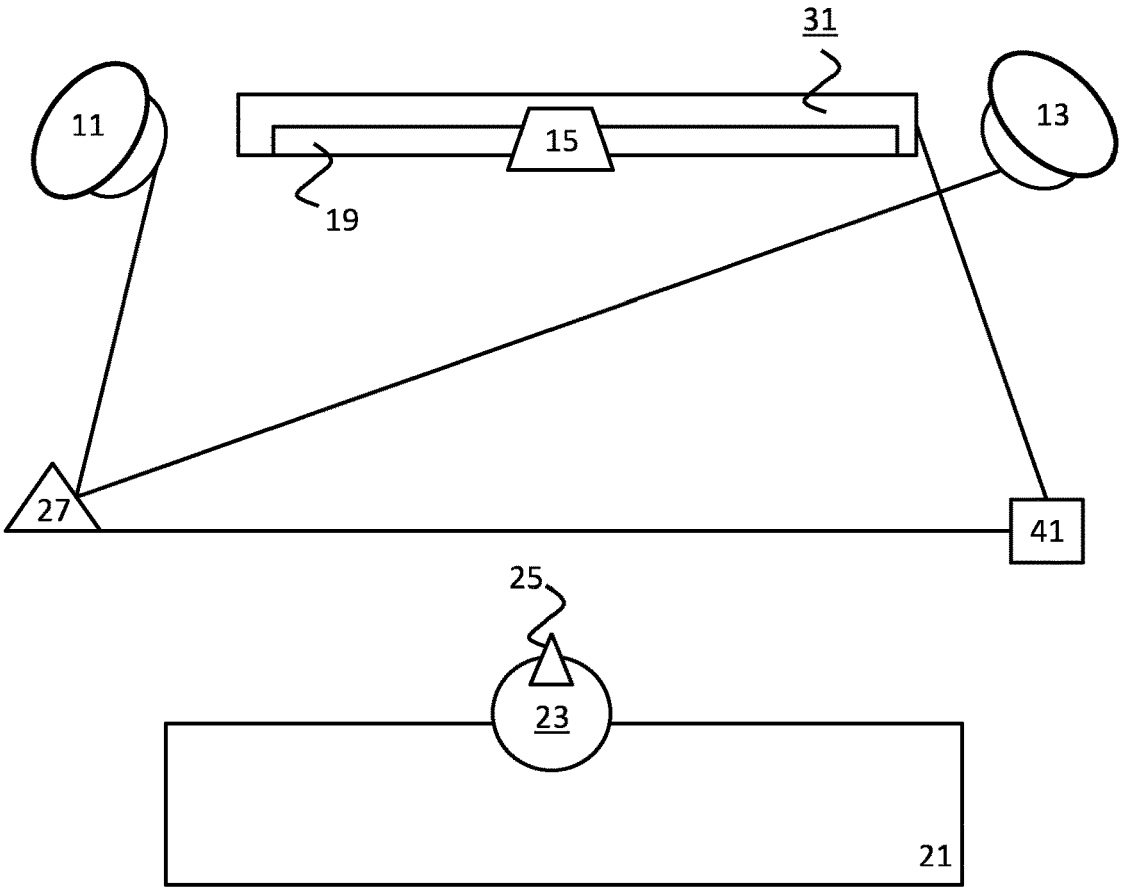
FIG. 5 is a block diagram of a system comprising a second embodiment of the electronic device of the invention.

FIG. 5 shows a second embodiment of the electronic device of the invention, a Television 31. Like bridge 1 of FIG. 1, bridge 27 of FIG. 5 controls lamps 11 and 13, e.g. via ZigBee or a protocol based on ZigBee. However, the invention is implemented in Television 31 instead of in bridge 27. The bridge 27 and the Television 31 are connected to, and communicate through, a wireless LAN (e.g. Wi-Fi/IEEE 802.11) access point 41, via a wire or wirelessly.

Figure 6:
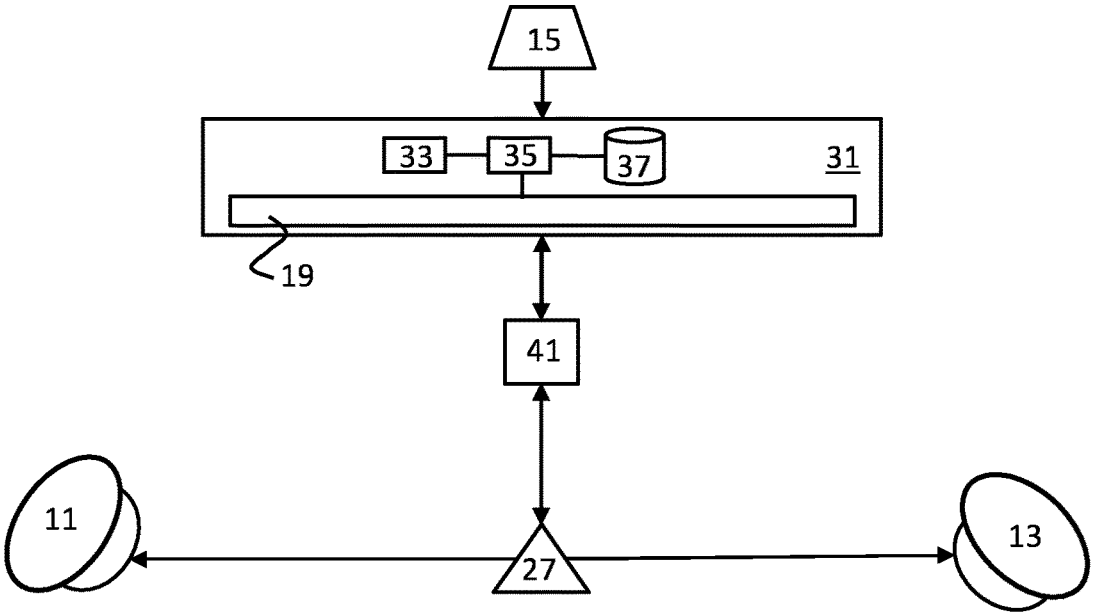
FIG. 6 is a block diagram of the second embodiment of the electronic device of FIG. 5.

The Television 31 comprises a processor 35, a transceiver 33, storage means 37, and a display 19, see FIG. 6. The processor 35 is configured to change a light state, e.g. the brightness, of lamp 11 and/or 13 while a user is watching content being displayed on the display 19, detect the user's attention shifting away from the display 19 based on data received from camera 15, determine whether the attention shift coincides with the change of the light state, and store a preference for the light state in dependence on the attention shift coinciding with the change of the light state. The preference comprises a preference for a light state with a less pronounced light effect than the changed light state (i.e. than the light state which is believed to have caused the attention shift). The arrows indicated in FIG. 6 are for illustrative purposes only, i.e. they illustrate the previously described communications, and do not exclude that communication takes places in a direction not indicated in FIG. 6.

A user of the Television 31 is able to associate the lamps 11 and 13 with names, create named rooms, assign the lamps 11 and 13 to the named rooms, and control the lamps 11 and 13 via a remote control of the mobile device Television 31 (which may be a dedicated remote control or a tablet or mobile phone configured as remote control). The light and room names and the light to room associations are stored in the Television 31.

The Television 31 comprises a display 19 on which it displays content. On top of the television is a camera 15. The camera 15 transmits image data to the Television 31, e.g. via a wire. The Television 31 analyzes the content displayed on the display 19 and maps the results to the lamps 11 and 13 based on the locations of the lamps 11 and 13, e.g. a left edge region of the display is mapped to lamp 11 and a right edge region is mapped to lamp 13. In this embodiment, these results comprise color and intensity values per edge region of the display 19 for several edge regions. The Television 31 then transmits commands to bridge 27 based on this mapping in order to controls lamps 11 and 13. A person 23 is sitting on a couch 21 looking at the display 19. In an alternative embodiment, the Television 19 analyzes the content, maps the results to the lamps 11 and 13 and transmits commands the bridge 27, but is not used to associate the lamps 11 and 13 with names, create named rooms or assign the lamps 11 and 13 to the named rooms. In this alternative embodiment, these latter functions are performed by another device, e.g. a mobile device running an appropriate application. The locations of the lamps 11 and 13 may then be obtained by the Television 31 from the bridge 27, for example.

Since it is the Television 31 that renders lights scripts, which may be obtained from another source or generated by the Television 31, light effects may be adapted more smartly than the bridge 1 of FIGS. 1 and 2 would be able to do, as the Television 31 has complete information about the light effect. As a first example, the Television 31 may determine a maximum brightness specified in a light script, divide the preferred maximum brightness by the maximum brightness specified in the light script to determine an adjustment percentage and applying the adjustment percentage to all brightness values specified in the light script before transmitting commands to the bridge 27. As a second example, the Television 31 may determine a brightness or color saturation value in a range between 0 and 1 based on the content of a left edge region of the display 19 and multiply this value with a preferred maximum brightness or color saturation before transmitting a command to bridge 27 to change a light state of the lamp 11. In the embodiment of FIG. 6, the invention is implemented in a Television. In an alternative embodiment, the invention may be implemented in another game or movie/TV playback device, e.g. a game console or mobile device.

In the embodiment of the Television 31 shown in FIG. 6, the Television 31 comprises one processor 35. In an alternative embodiment, the Television 31 comprises multiple processors. The processor 35 of the Television 31 may be a general-purpose processor, e.g. from MediaTek, or an application-specific processor. The processor 35 of the Television 31 may run an Android TV, Tizen, Firefox OS or WebOS operating system for example. In the embodiment shown in FIG. 6, a receiver and a transmitter have been combined into a transceiver 33. In an alternative embodiment, one or more separate receiver components and one or more separate transmitter components are used. In an alternative embodiment, multiple transceivers are used instead of a single transceiver. The transceiver 33 may use one or more wireless communication technologies to transmit and receive data, e.g. Wi-Fi, ZigBee and/or Bluetooth. The storage means 37 may store the preference(s), a lighting configuration and applications (also referred to as "apps") and application data, for example. The storage means 37 may comprise one or more memory units. The storage means 37 may comprise solid state memory, for example. The display 19 may comprise an LCD or OLED display panel, for example. The invention may be implemented using a computer program running on one or more processors.

Figure 7:
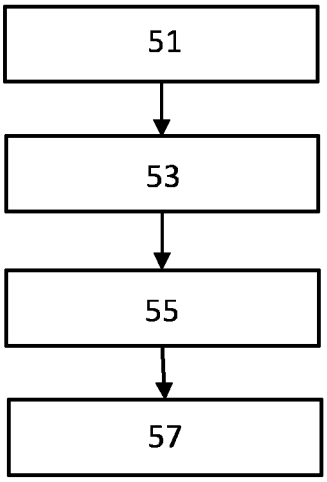
FIG. 7 is a flow diagram of an embodiment of the method of the invention.

A first embodiment of the method of the invention is shown in FIG. 7. A step 51 comprises changing a light state of at least one light source while a user is watching content being displayed on a display. A step 53 comprises detecting the user's attention shifting away from the display. A step 55 comprises determining whether the attention shift coincides with the change of the light state. A step 57 comprises storing a preference for the light state in dependence on the attention shift coinciding with the change of the light state. In this embodiment, the preference comprises a preference for a light state with a less pronounced light effect than the changed light state (i.e. than the light state which is believed to have caused the attention shift).

Figure 8:
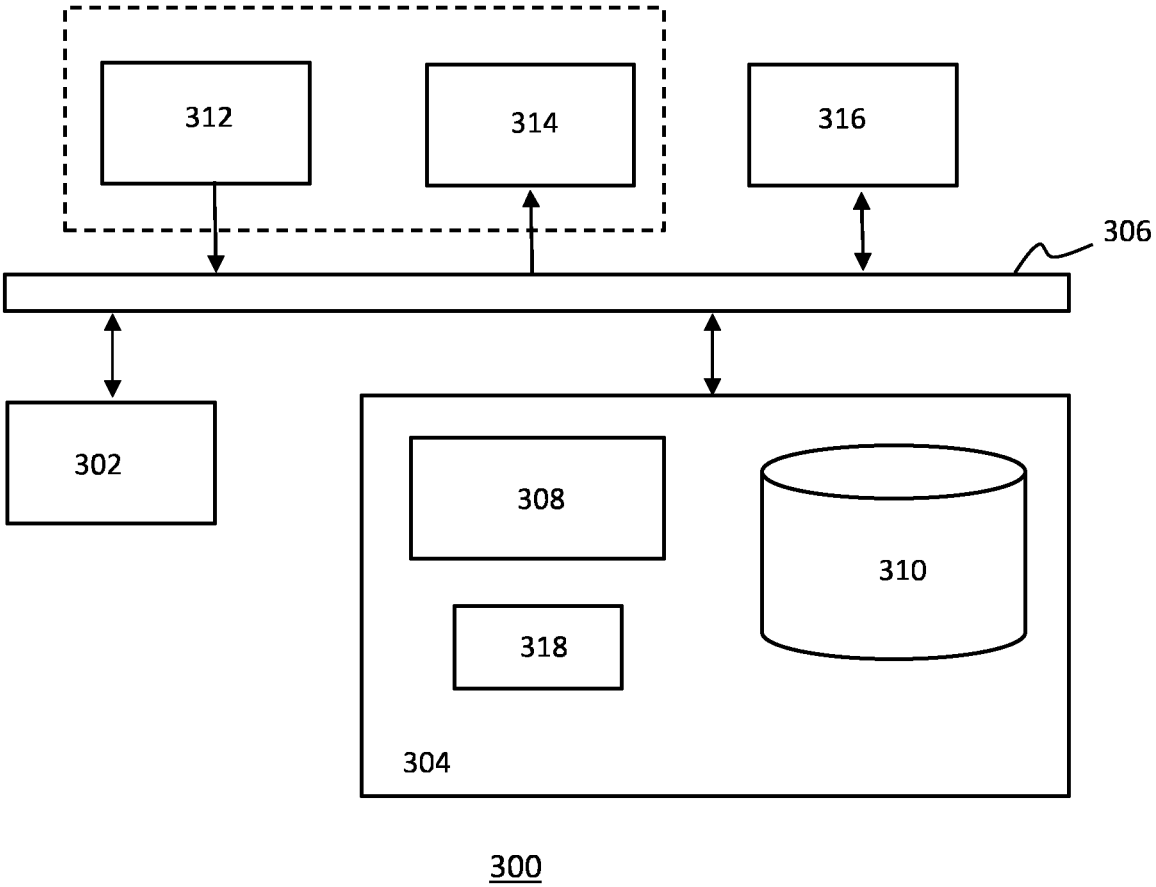
FIG. 8 is a block diagram of an exemplary data processing system for performing the method of the invention.

FIG. 8 depicts a block diagram illustrating an exemplary data processing system that may perform the method as described with reference to FIG. 7.

As shown in FIG. 8, the data processing system 300 may include at least one processor 302 coupled to memory elements 304 through a system bus 306. As such, the data processing system may store program code within memory elements 304. Further, the processor 302 may execute the program code accessed from the memory elements 304 via a system bus 306. In one aspect, the data processing system may be implemented as a computer that is suitable for storing and/or executing program code. It should be appreciated, however, that the data processing system 300 may be implemented in the form of any system including a processor and a memory that is capable of performing the functions described within this specification.

The memory elements 304 may include one or more physical memory devices such as, for example, local memory 308 and one or more bulk storage devices 310. The local memory may refer to random access memory or other non-persistent memory device(s) generally used during actual execution of the program code. A bulk storage device may be implemented as a hard drive or other persistent data storage device. The processing system 300 may also include one or more cache memories (not shown) that provide temporary storage of at least some program code in order to reduce the quantity of times program code must be retrieved from the bulk storage device 310 during execution.

Input/output (I/O) devices depicted as an input device 312 and an output device 314 optionally can be coupled to the data processing system. Examples of input devices may include, but are not limited to, a keyboard, a pointing device such as a mouse, or the like. Examples of output devices may include, but are not limited to, a monitor or a display, speakers, or the like. Input and/or output devices may be coupled to the data processing system either directly or through intervening I/O controllers.

In an embodiment, the input and the output devices may be implemented as a combined input/output device (illustrated in FIG. 8 with a dashed line surrounding the input device 312 and the output device 314). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 316 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 300, and a data transmitter for transmitting data from the data processing system 300 to said systems, devices and/or networks. Modems, cable modems, and Ethernet cards are examples of different types of network adapter that may be used with the data processing system 300.

As pictured in FIG. 8, the memory elements 304 may store an application 318. In various embodiments, the application 318 may be stored in the local memory 308, the one or more bulk storage devices 310, or separate from the local memory and the bulk storage devices. It should be appreciated that the data processing system 300 may further execute an operating system (not shown in FIG. 8) that can facilitate execution of the application 318. The application 318, being implemented in the form of executable program code, can be executed by the data processing system 300, e.g., by the processor 302. Responsive to executing the application, the data processing system 300 may be configured to perform one or more operations or method steps described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 302 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

The invention claimed is:

1. An electronic device for creating light effects related to content being displayed on a display to a user, the electronic device comprising at least one processor configured to:

change a light state of at least one light source;

detect an attention shift based on a change in an orientation of the user's head and/or the user's gaze after said change of said light state of at least one light source;

determine whether said attention shift coincides with said change of said light state of at least one light source; and store a preference for said light state at least one light source in dependence on said attention shift coinciding with said change of said light state of at least one light source.

2. The electronic device of claim 1, wherein said preference is a preference for a light state with a light effect which is less bright and/or less intense than said changed light state of at least one light source.

3. The electronic device of claim 1, wherein said at least one processor is configured to start controlling said at least one light source based on said preference in response to determining that said attention shift coincides with said change of said light state of at least one light source.

4. The electronic device of claim 3, wherein the determining that said attention shift coincides with said change of said light state of at least one light source is a determination that said attention shift is responsive to said change of said light state of at least one light source.

5. The electronic device of claim 1, wherein said at least one processor is configured to: store said preference, and/or start controlling said at least one light source based on said preference in response to determining that said attention shift has occurred a predetermined number of times coincident with a change of said light state of at least one light source.

6. The electronic device of claim 1, wherein said at least one processor is configured to detect the attention shift based on said user's attention shifting away from said display.

7. The electronic device of claim 6, wherein the attention shift is based on information received from augmented reality glasses.

8. The electronic device of claim 1, wherein said at least one processor is configured to detect said orientation of said user's head or said user's gaze moving in the direction of one or more of said at least one light source.

9. The electronic device of claim 1, wherein said at least one processor is configured to detect said user's attention shifting towards one or more of said at least one light source.

10. The electronic device of claim 1, wherein said at least one processor is configured to store said preference for said light state of at least one light source in dependence on said attention shift coinciding with said change of said light state of at least one light source only during a predetermined period.

11. The electronic device of claim 1, wherein said preference comprises a current preference value and said at least one processor is configured to determine a new preference value for said preference based on reducing or increasing said current preference value by a certain amount, wherein said certain amount is predefined in said electronic device or is specified in a light script.

12. The electronic device of claim 1, wherein said at least one processor is configured to store in history data whether said attention shift coincides with said change of said light state of at least one light source, said history data further indicating how many previous attention shifts have coincided with previous light state changes of said at least one light source, and store said preference and/or start controlling said at least one light source based on said preference in dependence on said history data.

13. The electronic device of claim 1, wherein said preference comprises a preference for a maximum intensity and/or a maximum brightness of said light state of at least one light source.

14. The electronic device of claim 1, wherein the determination of whether said attention shift coincides with said change of said light state of at least one light source is a determination of whether said attention shift is responsive to said change of said light state of at least one light source.

15. A method for creating light effects related to content being displayed on a display to a user, comprising:

changing a light state of at least one light source while a user is watching the content on the display;

detecting an attention shift based on a change in an orientation of the user's head and/or the user's gaze after said change of said light state of at least one light source;

determining whether said attention shift coincides with said change of said light state of at least one light source; and storing a preference for said light state of at least one light source in dependence on said attention shift coinciding with said change of said light state of at least one light source.

16. A non-transitory computer-readable storage medium comprising a code of instructions that cause at least one hardware processor to perform the method of claim 15 when the at least one hardware processor executes the code.

17. The non-transitory computer-readable storage medium of claim 16, wherein the determining whether said attention shift coincides with said change of said light state of at least one light source is a determination of whether said attention shift is responsive to said change of said light state of at least one light source.

18. The non-transitory computer-readable storage medium of claim 16, wherein the method further comprises: controlling said at least one light source based on said preference in response to determining that said attention shift coincides with said change of said light state of at least one light source, wherein the determining that said attention shift coincides with said change of said light state is a determination that said attention shift is responsive to said change of said light state of at least one light source.

19. The method of claim 15, wherein the determining whether said attention shift coincides with said change of said light state of at least one light source is a determination of whether said attention shift is responsive to said change of said light state of at least one light source.

20. The method of claim 15, further comprising:

controlling said at least one light source based on said preference in response to determining that said attention shift coincides with said change of said light state of at least one light source, wherein the determining that said attention shift coincides with said change of said light state of at least one light source is a determination that said attention shift is responsive to said change of said light state of at least one light source.

* * * * *